US010267211B2

(12) United States Patent
Turner et al.

(10) Patent No.: US 10,267,211 B2
(45) Date of Patent: Apr. 23, 2019

(54) COOLING SYSTEM

(71) Applicant: Ford Global Technologies, LLC, Dearborn, MI (US)

(72) Inventors: Paul Nigel Turner, Chelmsford (GB); Anthony Hughes, Brentwood (GB); Andrew Hitchings, Cardiff (GB)

(73) Assignee: Ford Global Technologies, LLC, Dearborn, MI (US)

( * ) Notice: Subject to any disclaimer, the term of this patent is extended or adjusted under 35 U.S.C. 154(b) by 86 days.

(21) Appl. No.: 15/473,392

(22) Filed: Mar. 29, 2017

(65) Prior Publication Data

US 2017/0284279 A1 Oct. 5, 2017

(30) Foreign Application Priority Data

Mar. 29, 2016 (GB) ..... 1605189.8

(51) Int. Cl.

| | |
|---|---|
| ***F01P 7/16*** | (2006.01) |
| ***F01P 3/20*** | (2006.01) |
| ***F01P 5/10*** | (2006.01) |
| ***F01P 5/12*** | (2006.01) |
| ***F01P 3/02*** | (2006.01) |
| ***F01P 3/14*** | (2006.01) |
| ***F02F 1/40*** | (2006.01) |

(Continued)

(52) U.S. Cl.

CPC ..... *F01P 7/165* (2013.01); *F01P 3/02* (2013.01); *F01P 3/14* (2013.01); *F01P 3/20* (2013.01); *F01P 5/10* (2013.01); *F01P 5/12* (2013.01); *F02F 1/40* (2013.01); *F01P 3/16* (2013.01); *F01P 2003/027* (2013.01); *F01P 2003/028* (2013.01); *F01P 2005/105* (2013.01); *F02F 2001/248* (2013.01)

(58) Field of Classification Search

CPC ..... F01P 7/165; F01P 3/02; F01P 3/14; F01P 3/20; F01P 5/10; F01P 5/12; F01P 3/16; F01P 2003/027; F01P 2005/105; F01P 2005/125; F02F 1/40; F02F 2001/248

USPC ..... 123/41.02, 41.05, 41.79, 41.31, 41.82 R

See application file for complete search history.

(56) References Cited

U.S. PATENT DOCUMENTS

| | | |
|---|---|---|
| 4,369,738 A | 1/1983 | Hirayama |
| 8,181,610 B2 | 5/2012 | Dipaola et al. |

(Continued)

*Primary Examiner* — Syed O Hasan

(74) *Attorney, Agent, or Firm* — Julia Voutyras; McCoy Russell LLP

(57) ABSTRACT

A cooling system for an internal combustion engine is provided. The cooling system comprises: a cooling passage provided within an engine housing of the engine, the cooling passage configured to carry a bulk flow of coolant to cool the engine housing, wherein the bulk flow of coolant within the cooling passage is driven by convection or a pump; and one or more additional cooling passages provided within the engine housing, each configured to introduce a flow of coolant into the cooling passage; one or more additional cooling passage pumps configured to pump coolant within the additional cooling passages; wherein the engine housing comprises one or more high temperature regions, which are at a higher temperature than one or more low temperature regions of the engine housing; and wherein the additional cooling passages are configured to direct the introduced coolant towards the one or more high temperature regions.

18 Claims, 6 Drawing Sheets

(51) Int. Cl.
*F01P 3/16* (2006.01)
*F02F 1/24* (2006.01)

(56) References Cited

U.S. PATENT DOCUMENTS

2012/0103283 A1* 5/2012 Mehring ..... F01P 3/02
123/41.02
2013/0055971 A1* 3/2013 Brewer ..... F02F 1/24
123/41.82 R
2014/0209046 A1* 7/2014 Steiner ..... F01P 5/10
123/41.31
2014/0283764 A1* 9/2014 Abou-Nasr ..... F01P 7/162
123/41.02
2015/0211408 A1* 7/2015 Maier ..... F01P 7/165
123/41.77

* cited by examiner

COOLING SYSTEM

CROSS REFERENCE TO RELATED APPLICATION

The present application claims priority to Great Britain Patent Application No. 1605189.8, filed on Mar. 29, 2016. The entire contents of the above-referenced application are hereby incorporated by reference in its entirety for all purposes.

TECHNICAL FIELD

The present disclosure relates to a cooling system for an engine and is particularly, although not exclusively, concerned with a cooling system configured to operate with reduced coolant flow rates.

BACKGROUND

Cooling systems for engines of vehicles, such as motor vehicles, typically include a pump configured to pump engine coolant around passages provided in the engine housings, such as the engine block and the cylinder head. In order to achieve sufficient cooling in all areas of the engine housings, it may be desirable for the flow rate of coolant through the passages to be high. Hence, cooling systems often implement a mechanical pump driven by the engine. Mechanical pumps are often large and heavy and can draw a large amount of power from the engine when operating.

SUMMARY

According to an aspect of the present disclosure, there is provided a cooling system for an internal combustion engine, the cooling system comprising: a cooling passage provided within an engine housing of the engine, the cooling passage configured to carry a bulk flow of coolant to cool the engine housing, wherein the bulk flow of coolant within the cooling passage is driven by convection or a pump; and one or more additional cooling passages provided within the engine housing, the or each additional cooling passage configured to introduce a flow of coolant midstream into the flow of coolant in the cooling passage; and one or more additional cooling passage pumps configured to pump coolant within the additional cooling passages; wherein the engine housing comprises one or more high temperature regions, which are at a higher temperature than one or more low temperature regions of the engine housing; and wherein the additional cooling passages are configured to direct the introduced coolant towards the one or more high temperature regions.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment of the invention.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION

Figure 1:
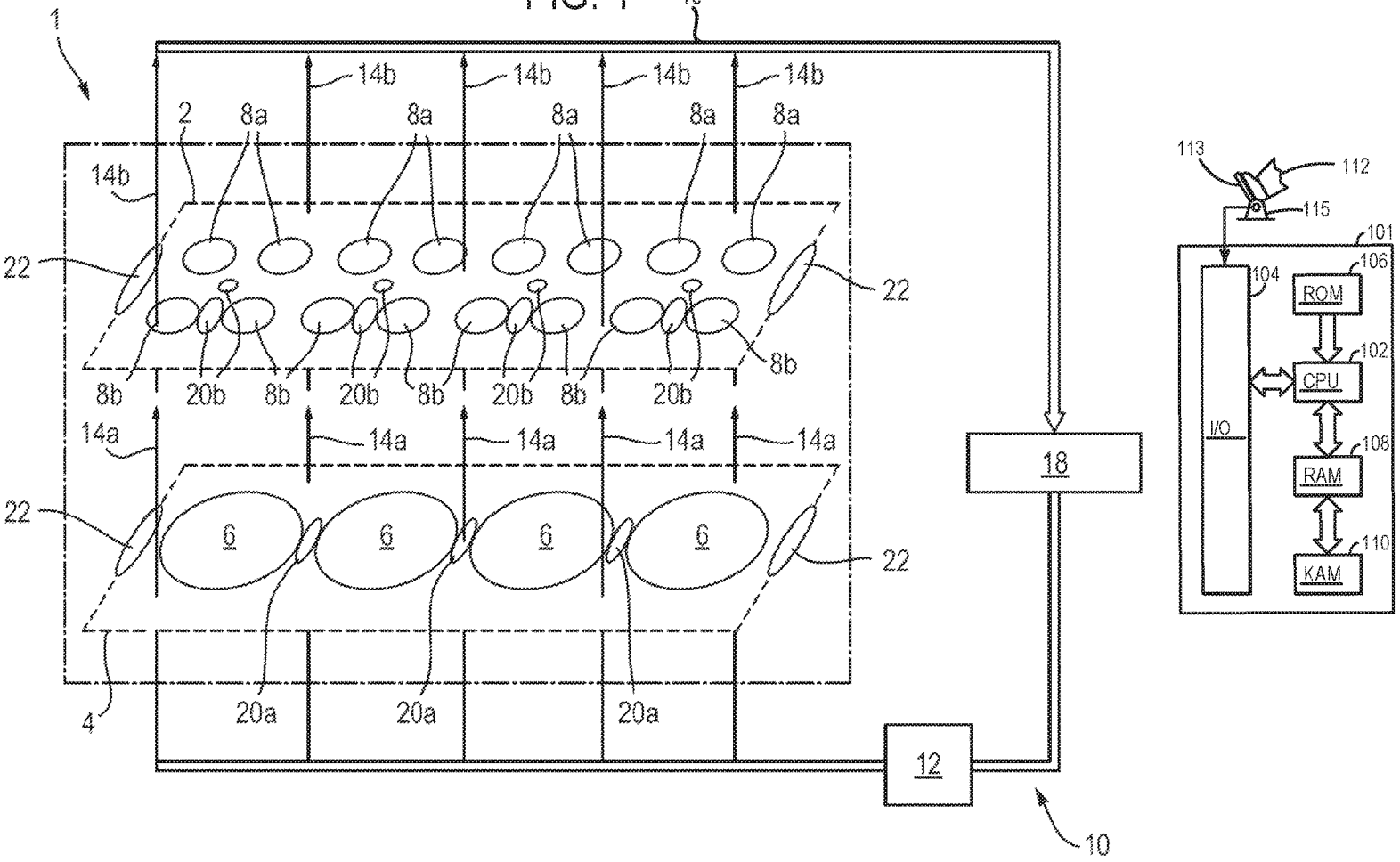
FIG. 1 is a schematic perspective view showing cross-sections through a cooling system.

According to an aspect of the present disclosure, there is provided a cooling system for an internal combustion engine, the cooling system comprising: a cooling passage provided within an engine housing of the engine, the cooling passage configured to carry a bulk flow of coolant to cool the engine housing, wherein the bulk flow of coolant within the cooling passage is driven by convection or a pump; and one or more additional cooling passages provided within the engine housing, each configured to introduce a flow of coolant into the cooling passage; and one or more additional cooling passage pumps configured to pump coolant within additional cooling passages; wherein the engine housing comprises one or more high temperature regions, which are at a higher temperature than one or more low temperature regions of the engine housing; and wherein the additional cooling passages are configured to direct the introduced coolant towards the one or more high temperature regions. Bulk flow as described herein is the movement of fluid (e.g., coolant) down pressure and/or temperature gradients. It will be appreciated that bulk flow of the coolant in the cooling system may drive convection in the system or a pump. Specifically in one example, the bulk flow of the coolant in specific coolant passages may be driven only by convection.

The additional cooling passages may extend through a wall of the cooling passage. The additional cooling passages may each comprise a nozzle configured to create a jet of coolant directed towards one or more high temperature regions of the engine housing. The nozzle may extend at least partially into the cooling passage. The nozzle may have a diameter that is less than 5 mm, e.g. 3 mm. The coolant from the additional cooling passages may first mix with coolant within the cooling passage upstream of, e.g. immediately upstream of, or adjacent to the high temperature region.

The cooling system may further comprise one or more pumps configured to pump the coolant within the additional cooling passages. For example, a single pump may be provided to pump the coolant within each of the additional cooling passages. Alternatively, two or more pumps may be provided and each configured to pump coolant within one or more of the additional cooling passages. In some arrangements, a pump may be provided for each of the additional cooling passages and the coolant within each of the second passages may be pumped separately. The pumps may be electrically driven pumps.

The flow of coolant within the cooling passage may be driven by convection, e.g., by thermosyphoning. In one example, the coolant within the cooling passage be driven only by convection and may not be pumped by a pump. The coolant within the cooling passage may flow at a first velocity. The pumps may be configured to pump the coolant in the additional cooling passages at a second velocity, which may be greater than the first velocity. The coolant from the additional cooling passages may enter the cooling passage at a high flow velocity. For example, the coolant from the additional cooling passages may enter the cooling passage at a flow velocity greater than 5 meters per second, such as 10 m/s.

The coolant entering the cooling passage from the additional cooling passages may be at a lower temperature than the coolant in the cooling passage upstream of, e.g. immediately upstream of, the additional cooling passage.

The cooling system may further comprise one or more temperature sensors configured to measure the temperatures of the engine housing. Additionally or alternatively, the temperature sensors may be configured to measure the temperature of the coolant within the cooling passage, e.g. at or close to the high temperature regions. The temperature sensors may be provided on the engine housing at or close to the high temperature regions. Additionally or alternatively, one or more of the temperature sensors may be provided on the nozzles.

The cooling system may further comprise a controller configured to determine temperatures of one or more of the high temperature regions. The temperatures may be determined by referring to one or more temperature sensors provided on the engine housing or nozzle. Additionally or alternatively, the temperature may be a predicted temperature, e.g. determined from a data model or look-up table of the controller.

The flow rate of coolant within the additional cooling passages may be controlled according to the temperatures of the one or more high temperature regions. Each of the one or more additional cooling passages may be configured to direct coolant towards a corresponding high temperature region of the engine housing. The flow rate of coolant within each of the additional cooling passages may be controlled according to the temperature of the corresponding high temperature region. For example, when the temperature of the corresponding high temperature region is above a threshold value, the flow rate of coolant within the additional cooling passage may be increased, e.g. the coolant may be pumped.

The cooling passage may be provided at least partially within a second engine housing and may be configured to cool the second engine housing. One or more of the additional cooling passages may be provided at least partially within the second engine housing. One or more of the of the additional cooling passages may be configured to direct coolant towards one or more high temperature regions of the second engine housing, which may be at higher temperatures than one or more low temperature regions of the second engine housing.

According to another aspect of the present disclosure, there is provided an internal combustion engine or vehicle comprising the cooling system according to a previously mentioned aspect of the disclosure.

According to another aspect of the disclosure, there is provided a method of cooling an engine housing, wherein the engine housing comprises one or more high temperature regions, which are at a higher temperature than one or more low temperature regions of the engine housing, the method comprising: providing a cooling passage within the engine housing, the cooling passage configured to carry a bulk flow of coolant through the engine housing; providing one or more additional cooling passages within the engine housing, each configured to introduce a flow of coolant into the cooling passage directed towards one or more of the high temperature regions of the engine housing; and providing a flow of coolant through one or more of the additional cooling passages.

The method may further comprise determining one or more temperatures of one or more of the high temperature regions. One or more of the temperatures may be determined based on measurements from one or more temperature sensors provided on the engine housing and/or on the nozzles. Additionally or alternatively, one or more of the temperatures may be determined by referring to a data model or look-up table of temperatures. One or more of the temperatures may be determined based on the power produced by the engine. The method may further comprise controlling the flow rate of coolant within one or more of the additional cooling passages according to one or more of the temperatures.

According to another aspect of the present disclosure, there is provided a controller comprising one or more modules configured to perform the method according to a previously mentioned aspect of the disclosure.

According to another aspect of the present disclosure, there is provided software which when executed by a computing apparatus causes the computing apparatus to perform the method according to a previously mentioned aspect of the disclosure.

With reference to FIG. 1, an engine 1, such as an internal combustion engine (ICE), comprises one or more housings. For example, as shown in FIG. 1, the engine 1 comprises a cylinder head 2 and a cylinder block 4. The cylinder block 4 defines one or more cylinders 6 and the cylinder head 2 defines one or more air inlet ports 8*a* and one or more exhaust ports 8*b*.

Each of the cylinders 6 may be in fluid communication with one, two or more of the air inlet and exhaust ports 8*a*, 8*b*. For example, in the arrangement shown in FIG. 1, each of the cylinders 6 is in fluid communication with two air inlet ports 8*a* and two exhaust ports 8*b*.

A valve (not shown) may be provided at each of the air inlet ports 8*a* and may be configured to open and close to selectively permit inlet air to flow through the air inlet ports 8*a* and enter the corresponding cylinders 6. Similarly, a valve (not shown) may be provided at each of the exhaust ports 8*b* configured to open and close to selectively permit exhaust gases to be exhausted from the cylinders 6.

Fuel may be mixed with inlet air within or upstream of the cylinders 6 and combusted. Gases produced through the combustion reaction may drive pistons (not shown) within the cylinders to turn a crank shaft of the engine (not shown).

In addition to producing combustion gases, which drive the engine, the combustion of fuel within the cylinders 6 also generates heat, which is absorbed by the cylinder head 2 and cylinder block 4, raising the temperature of the engine housings.

With reference to FIG. 1, in order to reduce the temperature of the engine housings, the engine 1 may include a cooling system 10. The cooling system 10 includes one or more cooling passages 14*a*, 14*b* provided within the engine housings. In some arrangements, the cooling passages 14*a*, 14*b* may be defined by the engine housings 2, 4. The engine housing 2 (e.g., cylinder head) may be referred to as a first engine housing and the engine housing 4 (e.g., cylinder block) may be referred to as a second engine housing or vice versa, in one example. The cooling system further includes a coolant pump 12, configured to pump a flow of coolant around the cooling system 10, e.g. through the cooling passages 14*a*, 14*b*. The coolant pump 12 may be a mechanical pump, which may be driven by the engine 1.

As shown in FIG. 1, one or more cooling passages 14*a* may be provided within the cylinder block 4. The cooling passages 14*a* provided with the cylinder block 4 may receive the coolant from the coolant pump 12. The cooling passages 14*a* within the cylinder block 4 may be configured to circulate the coolant around the cylinder block 4 to cool the cylinder block. As shown, coolant may flow within the cooling passages 14*a* through the section of the cylinder block 4 depicted in FIG. 1, e.g., towards the cylinder head 2. Additionally, coolant within the cooling passages 14*a* may flow around the cylinders 6, e.g., within the section of the cylinder block 4.

Coolant that has passed through the cooling passages 14*a* within the cylinder block 4 may enter one or more cooling passages 14*b* provided within the cylinder head 2. The cooling passages 14*b* within the cylinder head 2 are configured to circulate the coolant around the cylinder head 2 to cool the cylinder head. As depicted in FIG. 1, the cooling passages 14*b* may allow coolant to flow through the section of the cylinder head and may allow coolant to flow around the depicted section of the cylinder head 4, e.g., around the inlet and exhaust valve ports 8*a*, 8*b*.

Once the coolant has been circulated through the cooling passages 14*b* within the cylinder head 2, the coolant may leave the cooling passages 14*a*, 14*b* and may be carried by a cooling duct 16 to a radiator 18 of the cooling system 10. The radiator 18 may be configured to allow heat to be removed from the coolant. For example, the radiator may have a high surface area and may be arranged within a flow of air, such that heat is readily dissipated by the radiator.

One or more of the engine housings 2, 4 may include one or more high temperature regions 20*a*, 20*b*. During operation of the engine, the high temperature regions 20*a*, 20*b* of the engine housings may be heated by the combustion of fuel and/or the hot exhaust gases more than one or more low temperature regions 22 of the housing. As shown in FIG. 1, the cylinder head 2 may include a high temperature region 20*a* at or between one or more of the exhaust ports 8*b* and the cylinder block 4 may include a high temperature region 20*b* between each of the cylinders 6.

In order to ensure the high temperature regions 20*a*, 20*b* are cooled to a desired extent, it may be desirable for the coolant to be pumped through the cooling passages 14*a*, 14*b*, which are close or adjacent to the high temperature regions 20, at a high flow velocity. The high flow velocity may be higher than a flow velocity that would be needed in order to cool the low temperature regions 22 to a desired degree.

As described above, flow within each of the cooling passages 14*a*, 14*b* may be driven by the pump 12. Furthermore, many of the cooling passages 14*a* 14*b* may have substantially the same flow area. Hence, the flow velocity within each of the cooling passages 14*a*, 14*b* may be substantially the same, regardless of whether the cooling passage 14*a*, 14*b* is configured to cool a high temperature region 20 or a low temperature region 22. It may therefore be desirable to operate the pump 12 such that the flow velocity of coolant within each of the cooling passages 14*a*, 14*b* is high. The pump 12 may therefore need a large amount of power from the engine 1 in order to operate as desired.

In order to reduce the amount of power needed to pump coolant through the cooling passages 14*a*, 14*b* to cool all areas of the engine 1 to a desired extent, the engine 1 may include a cooling system 100 according to arrangements of the present disclosure.

Figure 2:
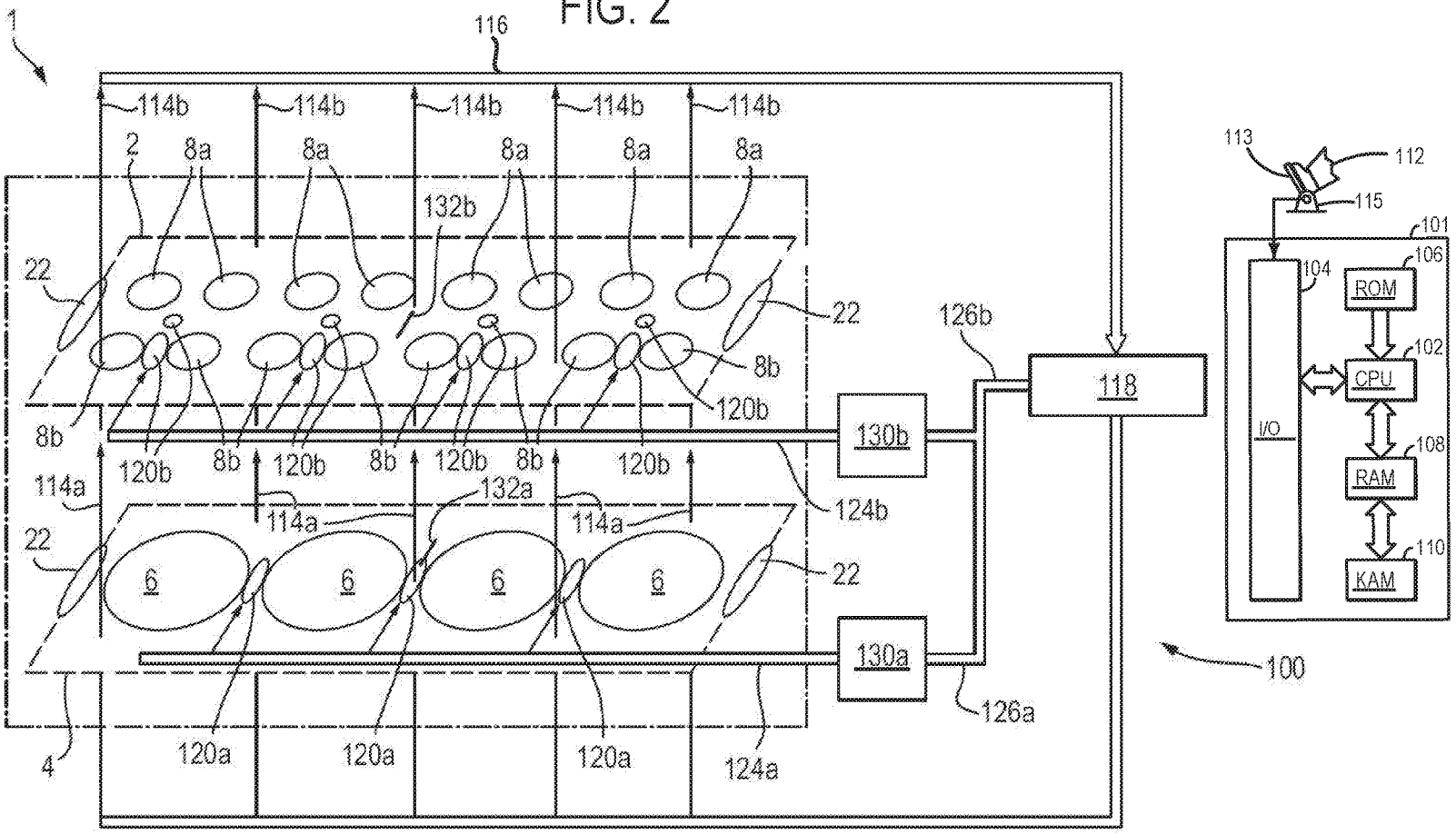
FIG. 2 is a schematic perspective view showing cross-sections through a cooling system according to arrangements of the present disclosure.

With reference to FIG. 2, the cooling system 100 according to arrangements of the present disclosure will now be described. The features of the engine 1, described above with reference to FIG. 1, may also apply to the arrangement shown in FIG. 2.

As depicted in FIG. 2, the cooling system 100 includes a plurality of cooling passages 114*a*, 114*b* provided within the engine housings, e.g., within the cylinder head 2 and the cylinder block 4. The cooling passages 114*a*, 114*b* may be substantially the same as the cooling passages 14*a*, 14*b* described above with reference to FIG. 1.

The cooling system 100 may further include a cooling duct 116, which receives coolant from the cooling passages 114*b*, e.g., the cooling passages provided in the cylinder head 2, and carries the coolant to a radiator 118.

The cooling system 100 further includes one or more additional cooling passages 124*a*, 124*b*. The additional cooling passages 124*a*, 124*b* may be provided within the engine housings 2, 4. In some arrangements, the additional cooling passages may be at least partially defined by the engine housings 2, 4. In the arrangement shown in FIG. 2, additional cooling passages 124*a*, 124*b* are provided in the cylinder block 4 and cylinder head 2 respectively. However, in other arrangements the additional cooling passages may be provided in only one of the cylinder head 2 and cylinder block 4. The provision of additional cooling passages 124*a*, 124*b* within each of the engine housings may depend on the cooling needs of the engine, e.g., on the locations of the high temperature regions 120. It will be appreciated that the high temperature regions 120 may have a higher temperature than the low temperature regions 122 during engine operation. At least a portion of the high temperature regions 120 may be adjacent to the exhaust ports 8*b* and/or the cylinders 6. For instance, regions between the cylinders may be high temperature regions.

The additional cooling passages 124*a*, 124*b* may receive coolant from the radiator 118 via one or more additional cooling ducts 126*a*, 126*b*. Each of the additional cooling passages 124*a*, 124*b* may receive coolant from a different one of the additional cooling ducts 126*a*, 126*b*. Alternatively, one or more of the additional cooling passages 124*a*, 124*b* may receive coolant from the same additional cooling duct. For example, as shown in FIG. 2, each of the additional cooling passages 124*a* provided in the cylinder block 4 may receive coolant from a first additional cooling duct 126*a*, and each of the additional cooling passages 124*b* provided in the cylinder head 2 may receive coolant from a second additional cooling ducts 126*b*.

Figure 3:
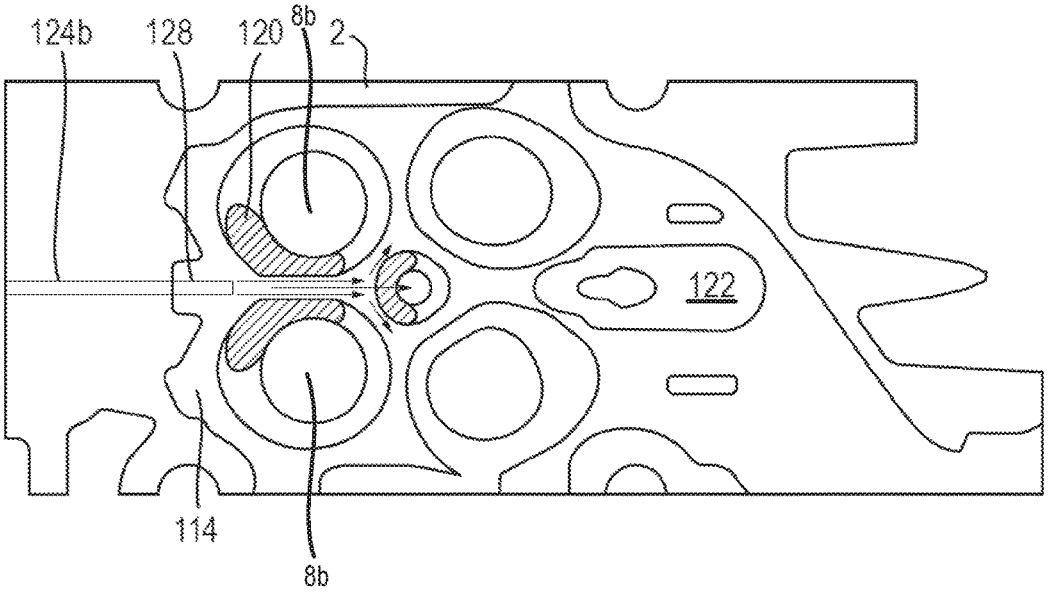
FIG. 3 is a sectional view of a cylinder head according to arrangements of the present disclosure.

With reference to FIG. 3, the additional cooling passages 124*a*, 124*b* are configured to introduce coolant into the cooling passages 114*a*, 114*b*. Coolant from the additional cooling passages 124*a*, 124*b* may be introduced midstream into the flow of coolant within the cooling passages 114*a*, 114*b*. Each of the additional cooling passages 124*a*, 124*b* may extend through a wall of the cooling passages 114. As described above, the cooling passages 114*a*, 114*b* may be defined by the engine housings 2, 4 and hence, the additional cooling passages 124*a*, 124*b* may extend through a portion of the engine housing that defines the wall of the cooling passage 114.

As shown in FIG. 3, each of the additional cooling passages 124*a*, 124*b* may include an optional nozzle 128. The nozzle 128 may be configured to create a jet of coolant into the cooling passages 114. The nozzle 128 may extend at least partially into the cooling passage 114. For example, the nozzle 128 may extend into the cooling passage 114*a*, 114*b* to allow the jet of coolant to be introduced at and/or directed towards a desired location. In some arrangements, the nozzle 128 may be omitted and the coolant from the additional cooling passages 124*a*, 124*b* may flow through an opening in the wall of the cooling passage 114. Additionally, the nozzle 128 is shown directing coolant into a region between the exhaust ports 8*b*. It will be appreciated that nozzles may also be used to direct coolant into sections of the cooling passage 114*a* between the cylinders 6 from the cooling passage 124*a*, in some examples.

It may be desirable for the jet of coolant to be introduced into the cooling passage 114*a*, 114*b* at a high velocity. For example, it may be desirable for the coolant introduced by the nozzle 128 (or opening) to have a velocity greater than 5 meters per second, such as 10 meters per second. In order to achieve a high flow velocity, the outlet of the nozzle 128 (or opening) may have a small diameter. For example, the nozzle outlet may have a diameter of less than 5 mm, e.g., 3 mm.

As described above, with reference to FIG. 1, when the engine is operating, one or more high temperature regions 120*a*, 120*b* of the engine housings 2, 4 may be heated by the engine more than one or more low temperature regions 122. The additional cooling passages 124*a*, 124*b* and/or the nozzles 128 (or openings) may be configured to preferentially cool the high temperature regions 120*a*, 120*b* of the engine housings. For example, as shown in FIGS. 2 and 3, the nozzle 128 may be configured to direct the jet of coolant towards one or more of the high temperature regions 120.

The coolant introduced by the additional cooling passages 124*b* may be at a lower temperature that the coolant within the cooling passages 114. It may therefore be desirable to decrease mixing of the coolant from the additional cooling passages 124*b* with coolant within the cooling passages 114 before the low temperature coolant reaches the high temperature regions 120. Therefore, the additional cooling passages and/or the nozzles 128 may be configured to introduce coolant immediately upstream of or adjacent to the high temperature regions 120, such that the coolant from the additional cooling passages first mixes with the coolant within the cooling passages at this location.

Figure 4:
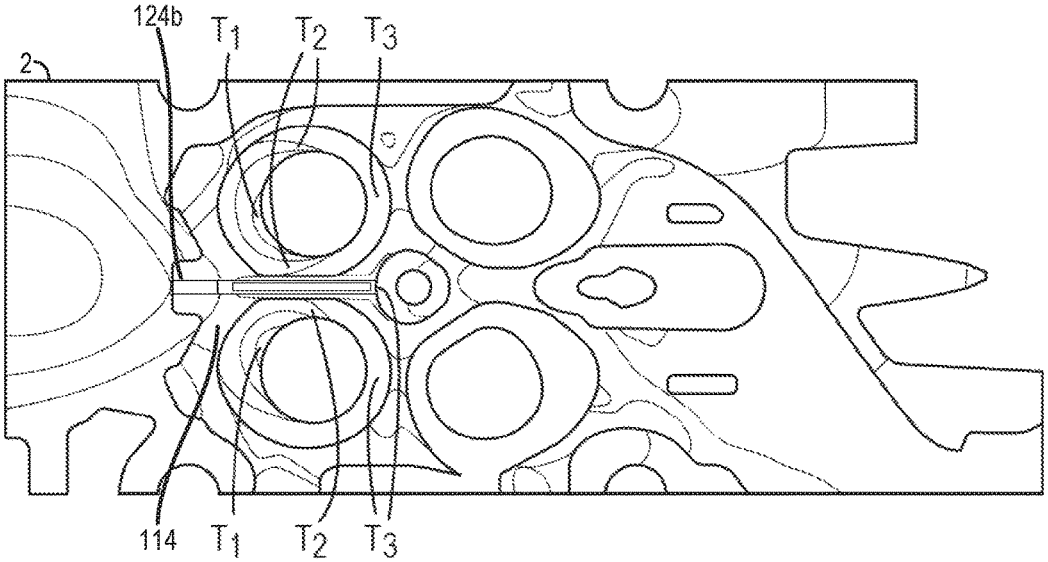
FIG. 4 is a section view of a cylinder head according to arrangements of the present disclosure, with contours showing the temperature of the cylinder head.

With reference to FIG. 4, by introducing coolant from additional cooling passage 124*b* into the cooling passage 114 and directing the coolant towards the high temperature region, the temperature of the high temperature regions 120 may be reduced. Additionally, FIG. 4 shows exemplary temperature contours in a section of the cylinder head 2. The temperatures T1, T2, and T3 depict temperatures in different regions. In one example, temperature T1 may be greater than T2 and temperature T3. Likewise, temperature T2 may be greater than temperature T3.

In the arrangement shown in FIGS. 2 to 4. The high temperature regions 120*a*, 120*b* may be cooled by the coolant from both the cooling passages 114*a*, 114*b* and the additional cooling passages 124*a*, 124*b*. Therefore, the flow rate of coolant needed in the cooling passages 114*a*, 114*b* may be reduced, e.g., compared to the flow rate of coolant in the cooling system 10 depicted in FIG. 1.

In some arrangements, it may not be desirable to include a coolant pump configured to pump the coolant within the cooling passages 114*a*, 114*b* in order to achieve the desired flow rate of coolant within the cooling passages 114. In such arrangements, coolant within the cooling passages 114*a*, 114*b* may be circulated by convection, e.g., by buoyancy forces within the coolant. In other words, coolant within the cooling passages 114*a*, 114*b* may be pumped by thermosyphoning. Specifically, in one example both convection and coolant pumps may be used to circulate coolant in the cooling system 100. In such an example, a first cooling circuit, including the cooling passages 114, may be driven by thermosyphoning while a second cooling circuit, including cooling passages 124, may be driven by the coolant pumps 130*a* and 130*b*. As shown, the flow of coolant through the cooling passages 114 may be at least partially in a vertical direction. That is to say, that coolant may travel from passages in the cylinder block 4 to passages in the cylinder head 2. Additionally, the cooling passages 124 and the cooling passages 114 are shown converging at or near the high temperature regions 120 (e.g., interbore regions) in FIG. 2. As previously, discussed, nozzles may be used to introduce coolant from the cooling passages 124 into the cooling passages 114. As such, the coolant flowrate and turbulence around the high temperature regions may be increased to increase cooling in targeted regions of the engine 1.

Although it may not be necessary to provide a pump to pump coolant within the cooling passages 114, it may be desirable to provide one or more additional coolant pumps 130*a*, 130*b* to pump the coolant within the additional cooling passages 124*a*, 124*b*. For example, in the arrangement shown in FIG. 2, first and second additional coolant pumps 130*a*, 130*b* are provided to each pump coolant within different ones of the additional cooling passages 124*a*, 124*b*. As shown in FIG. 2, the additional coolant pumps may be provided on the additional cooling ducts 126*a*, 126*b*.

As described above, it may be desirable for the flow velocity of coolant leaving the nozzle 138 to be high. Hence, the flow velocity of coolant within the additional cooling passages 124*a*, 124*b* may be higher than the flow velocity of coolant within the cooling passages 114*a*, 114*b*. However, the additional cooling passages 124*a*, 124*b* may be configured to cool a smaller proportion of the engine housings 2, 4 than the cooling passages 14 depicted in FIG. 1. Additionally, the flow area of the additional cooling passages 124*a*, 124*b* may be smaller than the flow area of the cooling passages 14. Hence, the flow rate of coolant within the additional cooling passages 124*a*, 124*b* may be lower than the flow rate of coolant within the cooling passages 14 in the arrangement shown in FIG. 1. The additional coolant pumps 130*a*, 130*b* may therefore need less power to operate than the coolant pump 12. In some arrangements, the additional coolant pumps 130*a*, 130*b* may be electrically driven.

When the engine is first started, the high temperature regions 120*a*, 120*b* may be substantially the same temperature as the low temperature regions 122. Hence, providing additionally cooling via the additional cooling passages 124*a*, 124*b* may not be desirable. Due to the cooling provided by the cooling passages 114, it may be possible for the engine to operate for a period of time before the high temperature regions 120*a*, 120*b* reach a desired high temperature that it becomes desirable to provide additional cooling via the additional cooling passages 124*a*, 124*b*. The additional coolant pumps 130*a*, 130*b* may not be operated until it is desirable to provide additional cooling.

The cooling system 100 may further include one or more temperature sensors 132*a*, 132*b*. The temperature sensors 132*a*, 132*b* may be provided on the engine housings 2, 4. For example, as depicted in FIG. 2, the cooling system 100 may include a first temperature sensor 132*a* provided in the cylinder block 4 and a second temperature sensor 132*b* provided in the cylinder head 2. The temperature sensors 132*a*, 132*b* may be provided at or close to the high temperature regions 120. The temperature sensors may be configured to measure a temperature of the material of the engine housing 2, 4 at or near the high temperature regions 120. Additionally or alternatively, the temperature sensors may be configured to measure a temperature of coolant within the cooling passages 114*a*, 114*b* at or adjacent to the high temperature regions 120.

Each of the temperature sensors may be provided at or close to a different one of the high temperature regions 120. Alternatively, one or more of the temperature sensors 132 may be provided close to two or more high temperature regions.

In an alternative arrangement (not shown) the temperature sensors 132*a*, 132*b* may be provided on the nozzles 128, e.g., at a distal end of the nozzle close to the high temperature region 120*a*, 120*b*.

As described above, each of the additional cooling passages 124*a*, 124*b* may be configured to provide coolant, which is directed towards one or more of the high temperature regions 120. Hence, each of the temperature sensors 132*a*, 132*b* may correspond to one of the additional cooling passages 124*a*, 124*b*, e.g., with a temperature sensor 132*a*, 132*b* for each additional cooling passage 124*a*, 124*b*. It may therefore be desirable to control the flow of coolant within each of the additional cooling passages 124*a*, 124*b* according to the temperature recorded by a corresponding temperature sensor 132*a*, 132*b*. For example, each of the additional coolant pumps 130*a*, 130*b* may be operated to pump coolant through a respective the additional cooling passages 124*a*, 124*b* when the temperature recorded by the temperature sensor 132*a*, 132*b* corresponding to the additional cooling passage 124*a*, 124*b* is above a threshold value. Additionally or alternatively, the flow rate of coolant within the additional cooling passages 124*a*, 124*b* may be controlled according to the temperature recorded by the corresponding temperature sensors, e.g., according to the temperature or one or more corresponding high temperature regions 120*a*, 120*b*.

Additionally or alternatively to providing the temperature sensors 132*a*, 132*b*, the cooling system 100 may include a controller 101 configured to determine, e.g., predict, the temperature of one of more of the high temperature regions of the engine housings. For example, the controller may consider operating power and/or time of the engine in order to predict the temperature of the high temperature regions 120*a*, 120*b* of the engine housings 2, 4. The controller may refer to a data model or look up table in order to determine, e.g., predict, the temperatures of the high temperature regions 120*a*, 120*b*. Additionally as shown in FIG. 1, the controller 101 may also be included in the cooling system 10.

The controller 101 is shown in FIGS. 1 and 2 as a conventional microcomputer including: microprocessor unit 102, input/output ports 104, read-only memory 106, random access memory 108, keep alive memory 110, and a conventional data bus. Controller 101 is configured to receive various signals from sensors coupled to engine 1. The sensors include temperature sensors 132*a* and 132*b*, exhaust gas sensors (not shown), an intake airflow sensor (not shown), etc. The controller 101 may also be configured to trigger one or more actuators in the engine 1 and specifically the cooling system 100 and/or the cooling system 10. For instance, the controller 101 may be configured to adjust the coolant pump 12, the coolant pumps 130*a*, 130*b*, a throttle, fuel injectors, fuel pumps, etc. Therefore, the controller 101 receives signals from the various sensors and employs the various actuators to adjust engine operation based on the received signals and instructions stored in memory of the controller.

Engine 1 may be controlled at least partially by a control system including controller 101 and by input from a vehicle operator 112 via an input device 113. In this example, input device 113 includes an accelerator pedal and a pedal position sensor 115 for generating a proportional pedal position signal PP. The predicted temperatures of the high temperature regions 120*a*, 120*b* of the engine housings may be considered to determine whether it is desirable to operate one or more of the additional coolant pumps 130*a*, 130*b*. Additionally, the determined, e.g., measured or predicted, temperatures of the high temperature regions 120*a*, 120*b* of the engine housings may be considered to determine the flow rate of coolant that should be provided within each of the additional cooling passages 124*a*, 124*b*.

Figure 5:
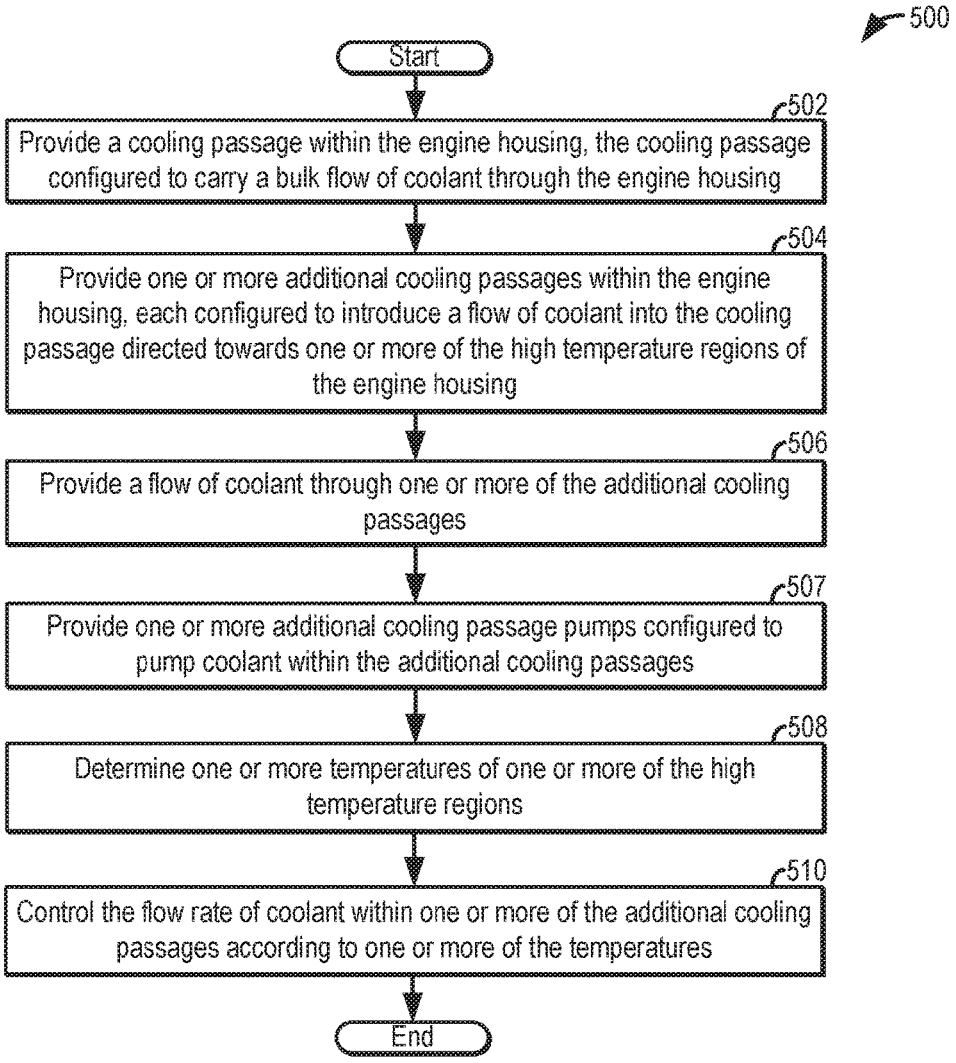
FIG. 5 is a method of cooling an engine housing.

FIG. 5 shows a method 500 of cooling an engine housing. In one example, the engine housing includes one or more high temperature regions, which are at a higher temperature than one or more low temperature regions of the engine housing. The method 500 may be implemented by the engine and engine system described above with regard to FIGS. 1-4. In other examples, the method 500 may be implemented by other suitable engines and engine systems.

At 502 the method includes providing a cooling passage within the engine housing, the cooling passage configured to carry a bulk flow of coolant through the engine housing. The bulk flow of coolant within the coolant passage may be driven by convection or a pump. Specifically in one example, the flow of coolant within the coolant passage may be driven only by convection.

Next at 504 the method includes providing one or more additional cooling passages within the engine housing, each configured to introduce a flow of coolant into the cooling passage directed towards one or more of the high temperature regions of the engine housing.

At 506 the method includes providing a flow of coolant through one or more of the additional cooling passages.

At 507 the method includes providing one or more additional cooling passage pumps configured to pump coolant within the additional cooling passages.

In some examples, the method may further include steps 508-510. At 508 the method includes determining one or more temperatures of one or more of the high temperature regions and at 510 the method includes controlling the flow rate of coolant within one or more of the additional cooling passages according to one or more of the temperatures. In one example, the flow rate may be controlled by one or more coolant pumps in the cooling system. Further in one example, one or more of the temperatures may be determined by referring to a data model or look-up table of temperatures. In yet another example, one or more of the temperatures may be determined based on at least one of the power produced by the engine and one or more temperature sensors provided on the engine housing. In this way, the temperatures can be inferred and/or sensed from sensors in the engine. Method 500 enables coolant, driven by pumps for example, to be injected or otherwise introduced into selected high temperature regions of the engine to facilitate efficient cooling of the engine. It will be appreciated that coolant flow in the coolant conduits into which the coolant is injected may be passive driven via thermosyphoning, in one example. Consequently, the use of additional coolant pumping can be avoided if desired, thereby increasing the efficiency of the cooling system.

Figure 6:
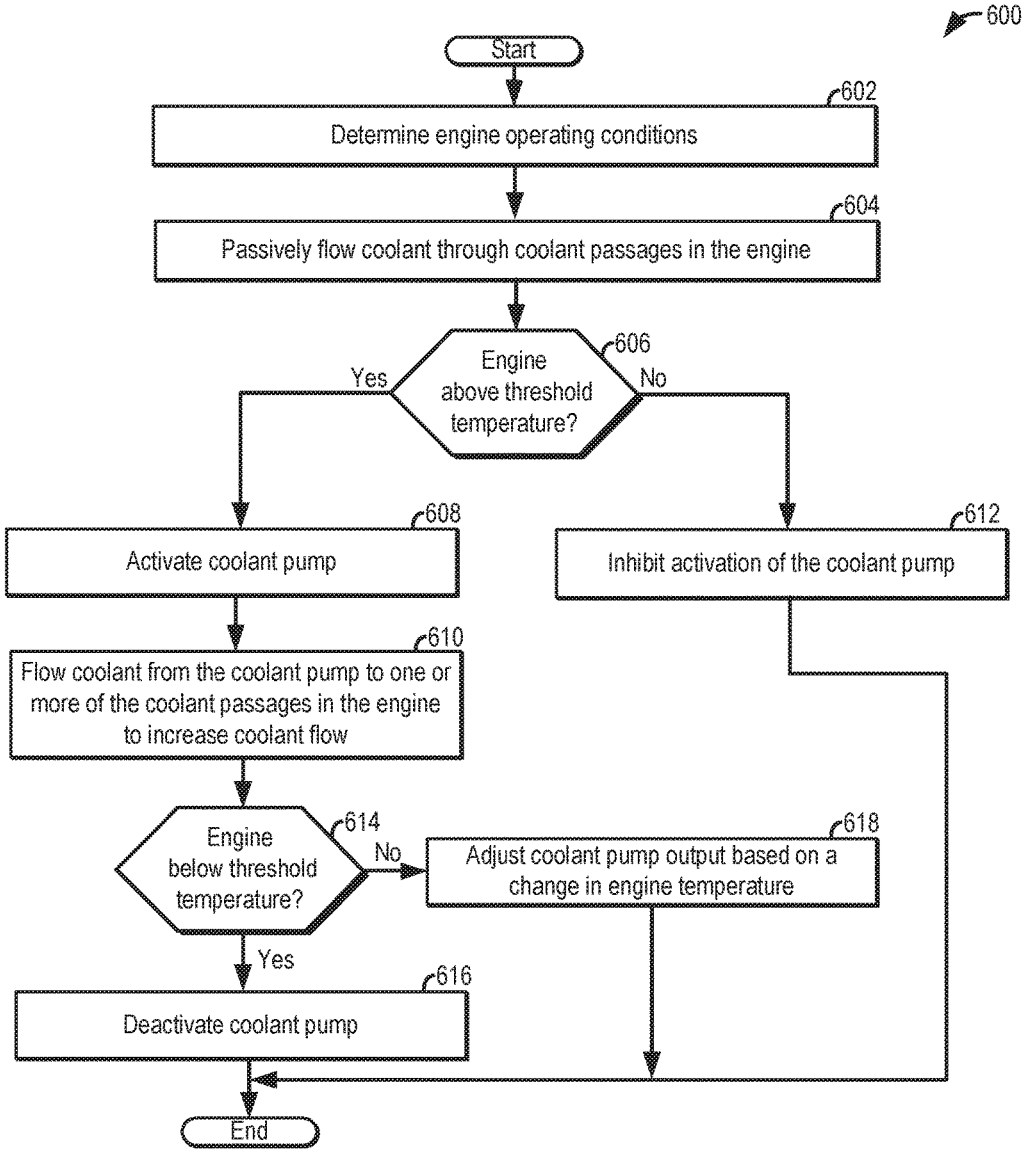
FIG. 6 is a method for operating a cooling system.

FIG. 6 shows a method for operating an engine cooling system. The method 600 may be implemented by the engine and engine system described above with regard to FIGS. 1-4. In other examples, the method 600 may be implemented by other suitable engines and engine systems.

At 602 the method includes determining engine operating conditions. The engine operating conditions may include engine temperature, engine speed, engine load, exhaust temperature, exhaust gas composition, intake airflow, etc. For instance, outputs from various sensors may be gathered by a controller. It will be appreciated that outputs from various sensor may be correlated to the engine parameters. For instance, inferences may be made from an engine temperature sensor coupled to the cylinder head or block, an exhaust temperature sensor, and/or an engine speed sensor to determine a temperature of a region adjacent to one or more exhaust ports.

At 604 the method includes passively flowing coolant through coolant passages in the engine. Specifically in one example, the flow of coolant within the cooling passage may be driven by convection, e.g., by thermosyphoning. In this way, engine cooling may be passively provided without the use of energy from crankshaft and/or energy storage device in the vehicle, for instance.

Next at 606 the method includes determining if the engine is above a threshold temperature. Specifically in one example, it may be determined if an area between and/or adjacent to exhaust ports of one or more cylinders is above a threshold value. In yet another example, it may be determined if engine speed is above a threshold value and if the engine temperature is above a threshold value.

If the engine is above the threshold temperature (YES at 606) the method advances to 608. At 608 the method includes activating a coolant pump in the engine cooling system. Next at 610, the method includes flowing coolant from the coolant pump to one or more of the coolant passages in the engine to increase coolant flow. Specifically in one example, the coolant passage receiving coolant from the coolant pump may be adjacent to one or more exhaust ports. Moreover, the velocity of the coolant flowed into the coolant passage may be higher than the velocity of the coolant flow in the coolant passage. In this way, the coolant flowrate and turbulence around desired engine regions may be increased to increase cooling in targeted engine regions. Further in one example, the coolant from the coolant pump may be flowed through a nozzle into the one or more coolant passages, to increase the velocity of the coolant introduced into the coolant passage. However, numerous devices, control schemes, etc., for increasing coolant velocity have been contemplated.

However, if the engine temperature is below the threshold temperature (NO at 606) the method advances to 612. At 612 the method includes inhibiting activation of the coolant pump. It will be appreciated that during each of steps 608, 610, and 612, passive coolant flow driven by convection may be sustained in the coolant passages. In this way, coolant may be convectively flowed through the cooling system during both periods of coolant pump activity and inactivity.

Next at 614 the method includes determining if the engine is below the threshold temperature. If it is determined that the engine is below the threshold temperature (YES at 614) the method advances to 616. At 616 the method includes deactivating the coolant pump. However, if it is determined that the engine is not below the threshold temperature (NO at 614) the method moves to 618. At 618 the method includes adjusting coolant pump output based on a change in engine temperature. Adjusting the coolant pump based on the change in engine temperature may include the routine described with regard to FIG. 7. It will be appreciated that in another example, step 618 may be omitted from method 600.

Figure 7:
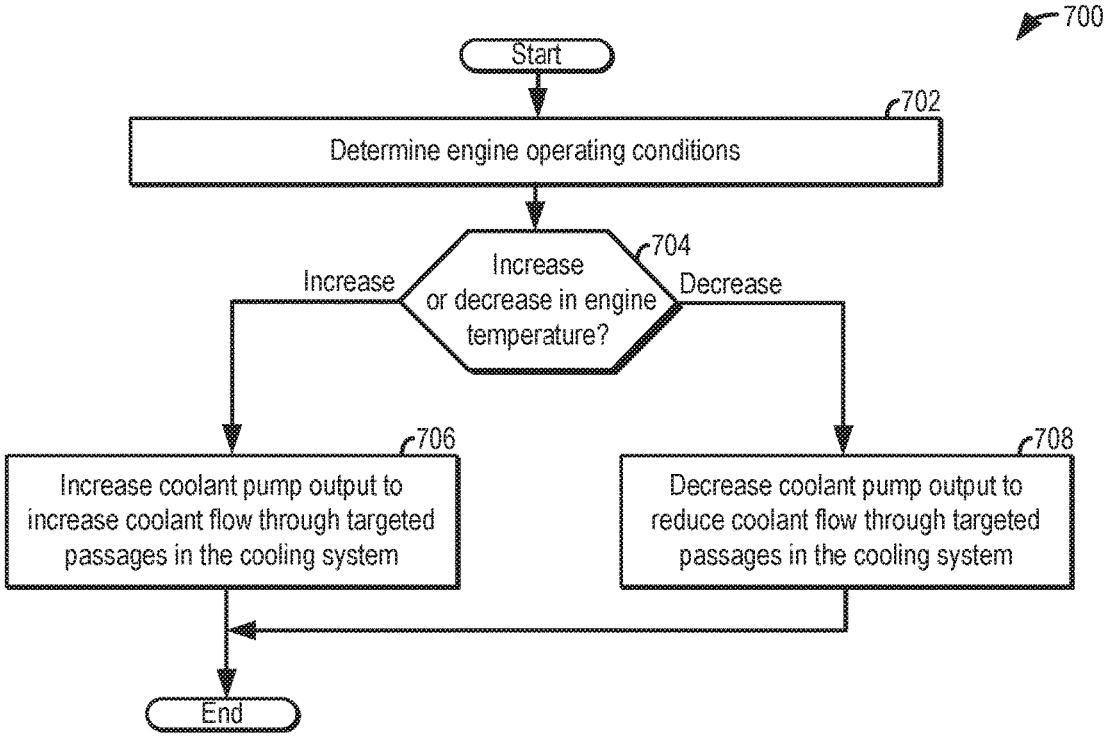
FIG. 7 shows another method for operating a cooling system.

FIG. 7 shows another method for operating an engine cooling system. The method 700 may be implemented by the engine and engine system described above with regard to FIGS. 1-4. In other examples, the method 700 may be implemented by other suitable engines and engine systems.

At 702 the method includes determining engine operating conditions and at 704 the method includes determining if the engine temperature is increasing or decreasing. If the engine temperature is increasing the method advances to 706 where the method includes increasing coolant pump output to increase coolant flow through targeted passages in the cooling system. However, if the engine temperature is decreasing the method advances to 708 where the method includes decreasing coolant pump output to reduce coolant flow through targeted passages in the cooling system. In this way, coolant pump output can be augmented to provide precise amounts of cooling to selected portions of the engine, when desired. As a result, the efficiency of the cooling system can be increased while providing a desired amount of engine cooling.

In yet another example, multiple coolant pumps may be correspondingly adjusted to provide targeted engine cooling in the cooling system. For instance, a first coolant pump may be activated when the temperature in a first engine region (e.g., cylinder head) is above a threshold value and a second coolant pump may be deactivated when the temperature in a second engine region (e.g., cylinder block) is below a threshold value or vice versa. In such an example, a first coolant pump may provide coolant to conduits in the first region (e.g., cylinder head) and a second coolant pump may provide coolant to conduits in the second region (e.g., cylinder block). In even another example, the first and second coolant pumps may be correspondingly adjusted (e.g., jointly increased or decreased during concurrent or overlapping time intervals). The coordination of the adjustment of the coolant pumps may again facilitate cooling system efficiency gains while reducing the likelihood of over-temperature conditions in the engine.

As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being triangular, helical, straight, planar, curved, rounded, spiral, angled, or the like). Further, elements shown intersecting one another may be referred to as intersecting elements or intersecting one another, in at least one example. Further still, an element shown within another element or shown outside of another element may be referred as such, in one example.

It will be appreciated by those skilled in the art that although the invention has been described by way of example, with reference to one or more exemplary examples, it is not limited to the disclosed examples and that alternative examples could be constructed without departing from the scope of the invention as defined by the appended claims.

Note that the example control routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described diagnostic routines. The subject matter of the present disclosure includes all novel and non-obvious combinations and sub-combinations of the various systems and configurations, and other features, functions, and/or properties disclosed herein.

The invention claimed is:

1. A cooling system for an internal combustion engine, the cooling system comprising:

a cooling passage provided within an engine housing of the engine, the cooling passage configured to carry a bulk flow of coolant to cool the engine housing, wherein the bulk flow of coolant within the cooling passage is driven by convection or a pump;

one or more additional cooling passages provided within the engine housing, the or each additional cooling passage configured to introduce a flow of coolant midstream into the flow of coolant in the cooling passage; and one or more additional cooling passage pumps configured to pump coolant within the additional coolant passages;

wherein the engine housing comprises one or more high temperature regions, which are at a higher temperature than one or more low temperature regions of the engine housing;

wherein the additional cooling passages are configured to direct the introduced coolant towards the one or more high temperature regions;

wherein the bulk flow of coolant within the cooling passage is driven only by convection;

wherein the bulk flow of coolant within the cooling passage is at a first velocity; and wherein the additional cooling passage pumps are configured to pump the coolant in the additional cooling passages at a second velocity, which is greater than the first velocity.

2. The cooling system of claim 1, wherein the additional cooling passages each comprise a nozzle configured to create a jet of coolant directed towards the one or more high temperature regions of the engine housing.

3. The cooling system of claim 2, wherein the nozzle extends at least partially into the cooling passage.

4. The cooling system of claim 1, wherein the coolant from the additional cooling passages first mixes with coolant within the cooling passage immediately upstream of or adjacent to the one or more high temperature regions.

5. The cooling system of claim 1, wherein the additional cooling passages extend through a wall of the cooling passage.

6. The cooling system of claim 1, wherein the flow of coolant within the cooling passage is driven by convection.

7. The cooling system of claim 1, wherein the coolant from the additional cooling passages enters the cooling passage at a flow velocity greater than 5 meters per second.

8. The cooling system of claim 1, wherein the coolant entering the cooling passage from the additional cooling passages is at a lower temperature than the coolant in the cooling passage immediately upstream of the additional cooling passages.

9. The cooling system of claim 1, further comprising one or more temperature sensors configured to measure temperatures of the engine housing.

10. The cooling system of claim 1, further comprising a controller configured to determine temperatures of the one or more high temperature regions.

11. The cooling system of claim 10, wherein a flow rate of coolant within the additional cooling passages is controlled according to the temperatures of the one or more high temperature regions.

12. The cooling system of claim 1, wherein each of the one or more additional cooling passages is configured to direct coolant towards a corresponding high temperature region of the engine housing; and wherein a flow rate of coolant within each of the additional cooling passages is controlled according to a temperature of the corresponding high temperature region of the engine housing.

13. The cooling system of claim 1, wherein the cooling passage is at least partially provided in a second engine housing and is configured to cool the second engine housing.

14. The cooling system of claim 13, wherein one or more of the additional cooling passages are at least partially provided within the second engine housing, wherein one or more of the of the additional cooling passages are configured to direct coolant towards one or more high temperature regions of the second engine housing, which are at higher temperatures than one or more low temperature regions of the second engine housing.

15. A method comprising:

providing cooling passages configured to carry a bulk flow of coolant through an engine housing, wherein the bulk flow of coolant within the cooling passages is driven by convection or a pump, and wherein at least one of the cooling passages is configured to cool a low temperature region of the engine housing;

providing one or more additional cooling passages in a horizontal arrangement within the engine housing, each configured to introduce a flow of coolant into the cooling passages directed towards one or more high temperature regions of the engine housing, wherein the cooling passages rise upwards to intersect with the one or more additional cooling passages;

providing one or more additional cooling passage pumps configured to pump coolant within the one or more additional cooling passages; and providing a flow of coolant through the one or more additional cooling passages.

16. The method of claim 15, wherein the method further comprises:

determining one or more temperatures of the one or more high temperature regions; and controlling the flow rate of coolant within the one or more additional cooling passages according to the one or more temperatures.

17. The method of claim 16, wherein the one or more temperatures are determined by referring to a data model or a look-up table of temperatures.

18. The method of claim 16, wherein the one or more temperatures are determined based on at least one of power produced by an engine and one or more temperature sensors provided on the engine housing.

* * * * *